US005280869A

United States Patent [19]

Ricci

[11] Patent Number: 5,280,869

[45] Date of Patent: Jan. 25, 1994

[54] BORDER APPLYING AID

[76] Inventor: Anita R. Ricci, 76 Des Grives Boulevard, Suite 3, Hull, Quebec, Canada, J9A 2X8

[21] Appl. No.: 959,370

[22] Filed: Oct. 13, 1992

[51] Int. Cl.[5] ..... B65H 75/40

[52] U.S. Cl. ..... 248/309.2; 242/96

[58] Field of Search ..... 248/309.2; 242/55.2, 242/55.4, 96; 156/575, 577

[56] References Cited

U.S. PATENT DOCUMENTS

| | | | |
|---|---|---|---|
| 624,809 | 5/1899 | Howe | 248/309.2 |
| 2,537,613 | 1/1951 | Allen | 242/96 X |
| 2,586,626 | 2/1952 | Dunn | 248/309.2 |
| 3,370,805 | 2/1968 | Barbee | 248/309.2 X |
| 3,656,700 | 4/1972 | Gauvin | 247/55.54 X |
| 4,248,391 | 2/1981 | Ness | 242/55.54 |
| 4,487,376 | 12/1984 | Compton | 242/55.54 |
| 4,722,493 | 2/1988 | Parry et al. | 242/96 |
| 4,834,312 | 5/1989 | Riemenschneider | 242/96 |
| 5,115,648 | 5/1992 | Salvucci | 242/96 X |

FOREIGN PATENT DOCUMENTS

| | | | |
|---|---|---|---|
| 724498 | 12/1965 | Canada | 156/575 |
| 701731 | 3/1931 | France | 248/309.2 |

*Primary Examiner*—Alvin C. Chin-Shue

*Attorney, Agent, or Firm*—Wenderoth Lind & Ponack

[57] ABSTRACT

An implement for use in applying strip material such as wallpaper borders to vertical walls comprises a holder which carries an upright spindle over which a roll of the strip material is received. The holder includes a reservoir to receive liquid which may drip from the roll of strip material, the roll being held clear of the liquid in the reservoir by a support on the spindle.

11 Claims, 2 Drawing Sheets

BORDER APPLYING AID

BACKGROUND OF THE INVENTION

A. Field of the Invention

This invention relates to a new or improved implement useful for applying strip material horizontally to vertical walls, and particularly designed to aid the application of wallpaper frieze or border strips to the walls of rooms e.g. in homes, offices, hotels and the like.

B. Description of Prior Art

Hitherto, wallpaper borders or friezes to be applied horizontally on room walls were handled manually, albeit with some inconvenience. In the past such borders were usually fairly narrow, e.g. up to two inches in width, but in recent times wider borders of six to eight inches in width have become popular, and these are much more difficult and inconvenient to work with.

SUMMARY OF THE INVENTION

It is accordingly an object of the invention to provide an implement which will act as an aid in applying horizontal strips of material to upright walls, and in particular in applying wallpaper borders to the walls of rooms.

The invention accordingly provides an implement useful in applying strip material to an upright surface to extend generally horizontally thereon, comprising, a holder having a projecting elongate spindle, said holder being manually engageable by a single hand of a user to be carried thereby and oriented with said spindle extending upwardly from said holder; said spindle having an unobstructed length that is sufficient to support a hollow roll of the strip material and terminating in a free upper end; support means around said spindle defining a support for the lower end of such hollow roll; said implement including a peripheral wall substantially totally surrounding said spindle at a spacing to accommodate with clearance the lower end of such hollow roll, said wall having an upper edge above said support means so as to enclose in use the lower end portion of such hollow roll; and said holder including a reservoir which in use receives and holds liquid which may drain from a hollow roll carried on said spindle.

The support means is preferably a perforate plate that is carried by the spindle and is positioned to hold the lower end of the hollow roll spaced above any liquid that may be contained in the reservoir. Although the spindle may be formed integrally with or fixed to the holder, it is preferably made to be separable together with the support means so that the combination of spindle and support means can be used as a carrier for immersing a roll of pre-pasted border material in water.

The holder preferably defines an elongate handle that is generally aligned with the spindle and is integral with the peripheral wall, the reservoir being formed at least in part within the handle.

The spindle may be rotatable relative to the handle to facilitate unwinding of a roll therefrom. The peripheral wall may include a slot opening downwardly from the upper edge thereof to a level of the support means to provide clearance for the lower edge of the strip of material as it is unwound from the roll.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
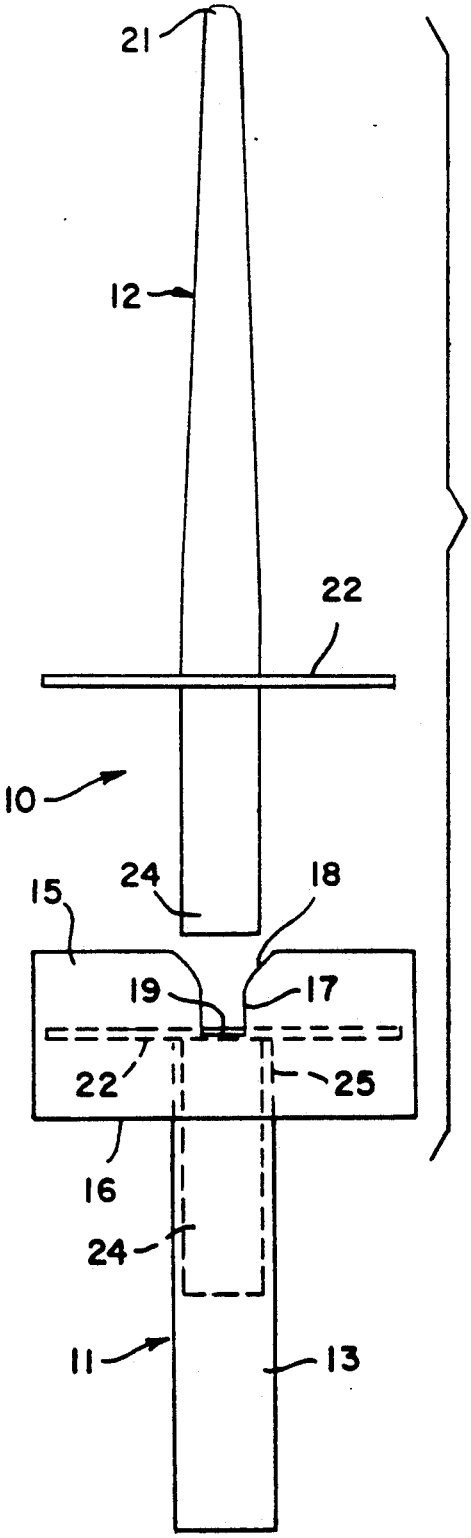
FIG. 1 is an exploded side view of a preferred form of implement in accordance with the invention, designed as an aid for applying wallpaper borders.
Figure 1A:
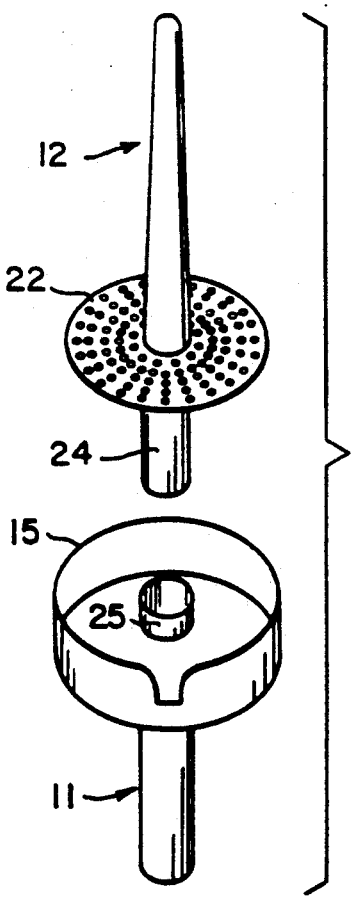
FIG. 1A is an exploded perspective view corresponding to FIG. 1.
Figure 2:
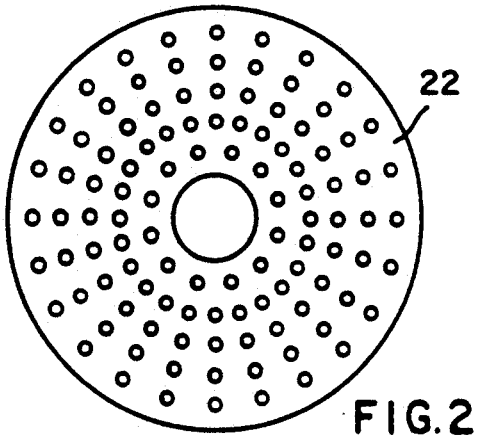
FIG. 2 is a plan view of a portion of FIG. 1.

As indicated in FIG. 1, the implement 10 comprises two main parts namely a holder 11 and a spindle 12. The holder 11 comprises a straight round handle 13 at the upper end of which is an enlarged cylindrical tray section bounded by a peripheral wall 15 and a base 16. An extension of the handle projects upwardly and has an upper edge at a level that is about mid-way in the height of the wall 15. The handle 13 is hollow and communicates with the bottom of the tray section, e.g. through openings or slots (not shown) in the extension 14 to define a liquid reservoir. There is a slot 17 having a rounded entranceway 18 opening from the upper edge of the peripheral wall 15.

The spindle 12 comprises an elongate rod that is generally cylindrical but is slightly tapered towards a rounded upper end 21. A circular perforated plate 22 is attached at a predetermined position in the length of the spindle 12.

With the plate 22 positioned as shown in broken lines in FIG. 1, the lower end 24 of the spindle is received within the handle 13, and the plate 22 is at a level where its upper surface is just above the lower edge 19 of the slot 17.

Figure 3:
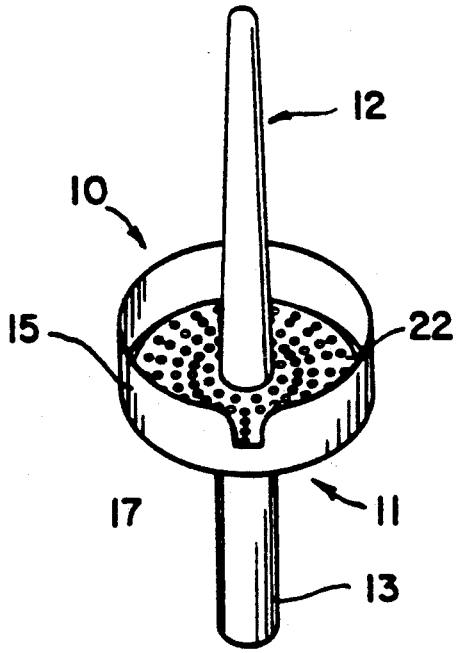
FIG. 3 is a schematic view of the implement of FIG. 1 shown assembled.
Figure 4:
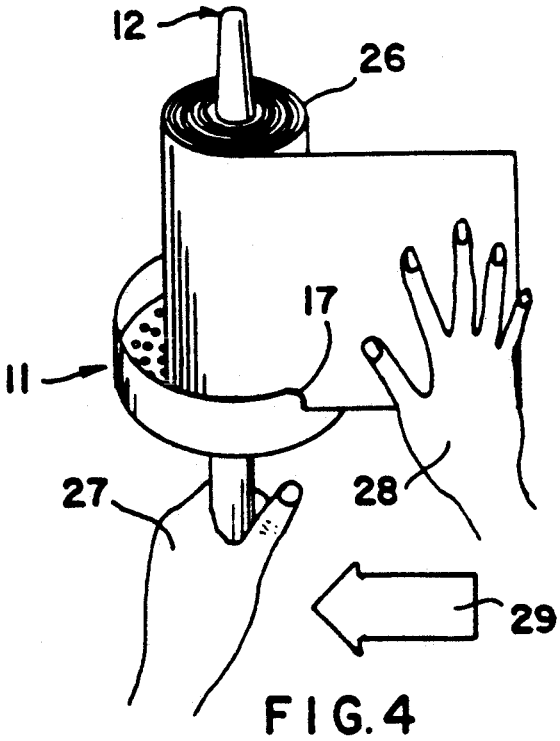
FIG. 4 is a view similar to FIG. 3 but showing the implement carrying a hollow roll of strip material.

The use of the border applying implement will be described with reference to FIGS. 3, 4 and 5 of the drawings. The spindle 12 together with the perforate plate 22 is separated from the holder as shown in FIG. 1 and a hollow roll of pre-pasted wallpaper border material 26 (FIG. 4) is placed over the spindle to sit upon the plate 22. As supplied from the manufacturer, such rolls are tightly wound, but since they have to be soaked in water to activate the adhesive, it is first necessary to loosen the roll so that water can penetrate between its various turns. The loosened roll upon the spindle 12 can be immersed in water to activate the adhesive paste, and during this immersion the spindle is held by its upper end 21 so that the users hand does not have to enter the water. The roll 26 upon the spindle is allowed to stand in the water for the appropriate period, usually about 5 minutes, and then can be removed and the spindle placed in the holder 11 as illustrated in FIG. 4. The roll 26 of course even after a period of draining still contains an excess of water which will continue to drain downwardly therefrom. The excess water will drain through the perforated plate into the reservoir defined by the tray portion and handle 13 of the holder 11.

To apply the roll to a wall, the holder is gripped in the left hand 27 of the user, and the strip material is withdrawn from the roll and applied against the wall by the user's right hand 28. It will be appreciated that from the position shown in FIG. 4 with the leading end of the strip of material pressed against a wall by the right hand, movement of the implement 10 to the left as indicated by the arrow 29 in FIG. 4 will cause the roll 26 to unroll to unwind material therefrom. It will be noted that the lower marginal portion of the material strip passes through the slot 17 in the peripheral wall 15 of the holder. Thus the peripheral wall, apart from the opening provided by the slot 17, provides an upwards extension of the container that is formed by the holder to receive liquid dripping from the roll 26 in use.

Figure 5:
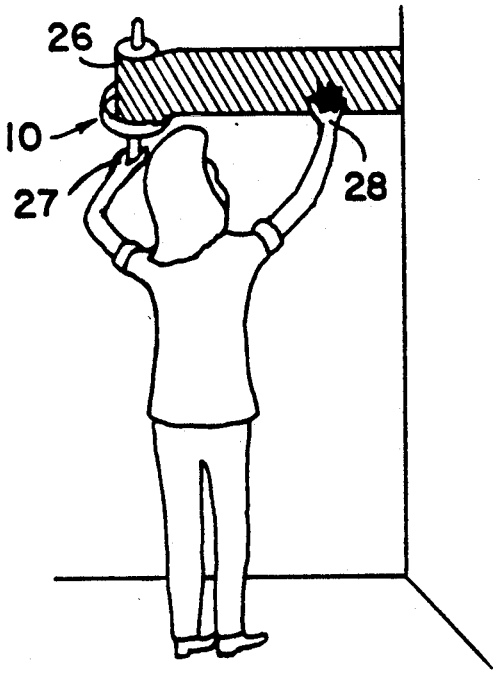
FIG. 5 is a somewhat schematic view showing the implement in use.

As illustrated in FIG. 5, the material can be drawn continuously from the roll 26 and applied against the wall, the user working leftward and smoothing the applied strip with the right hand. It will be appreciated that a great length of material may be included within the roll 26, and certainly much more than could be conveniently handled by the user without the aid of such an implement.

The ability of the holder to catch and retain excess water dripping from the roll 26 is a great benefit since it reduces the risk of damage to furnishings. After use, the implement can be readily cleaned simply by detaching the spindle and plate from the holder as illustrated in FIG. 1 and rinsing the various parts in water.

The implement 10 may be fabricated in any suitable materials. Conveniently all parts may be of suitable plastics material, and the holder 11 for example may be a unitary plastics molding pre-formed with the slot 17.

What I claim as my invention is:

1. An implement useful in applying strip material to an upright surface to extend generally horizontally thereon, comprising:

a portable holder;

an elongate spindle;

means for supporting said spindle on said holder in readily releasable manner with one end of said spindle received in said holder and a second free end of said spindle projecting from said holder;

said holder including a handle that is manually engageable by a single hand of a user to be carried thereby and oriented with said spindle extending upwardly from said holder;

said spindle having an unobstructed length that is sufficient to support a hollow roll of the strip material;

support means around said spindle defining a support for the lower end of such hollow roll;

said implement including a peripheral wall substantially totally surrounding said spindle at a spacing to accommodate with clearance the lower end of such hollow roll, said wall having an upper edge above said support means so as to enclose in use the lower end portion of such hollow roll; and said holder including a reservoir which in use receives and holds liquid which may drain from a hollow roll carried on said spindle, said reservoir being located beneath said support means so that in use the hollow roll is maintained out of contact with such drained liquid.

2. An implement according to claim 1 wherein said handle is of elongate form and is generally aligned with said spindle, said reservoir being defined at least in part within said handle.

3. An implement as claimed in claim 1 wherein said wall includes a slot opening downwardly from the upper edge thereof to a level corresponding to that of said support means.

4. An implement as claimed in claim 1 wherein said spindle is rotatable relative to said holder.

5. An implement as claimed in claim 1 wherein said support means is carried by said spindle and is separable from said holder together with said spindle.

6. An implement as claimed in claim 1 wherein said handle is of elongated form and defines therein at least a part of said reservoir, said handle being integral with said peripheral wall.

7. An implement as claimed in claim 6 wherein said support means is carried by said spindle and is separable from said holder together with said spindle, said spindle being releasably supported by said holder by said one end of the spindle extending partially within said handle.

8. An implement as claimed in claim 6 wherein said peripheral wall includes a slot that opens downwardly from the upper edge thereof to a level corresponding to that of said support means.

9. An implement as claimed in claim 3 wherein said support means is carried by said spindle and is separable from said holder together with said spindle.

10. An implement as claimed in claim 1 wherein said handle is of hollow tubular form and defines at least a part of said reservoir, said one end of said spindle being receivable within said handle, and said spindle being rotatable relative to said holder.

11. An implement as claimed in claim 9 wherein said one end of the spindle has an end face that is substantially perpendicular to the length of said spindle.

* * * * *